US006907977B1

(12) United States Patent
Barchuk

(10) Patent No.: US 6,907,977 B1
(45) Date of Patent: Jun. 21, 2005

(54) CAPACITANCE SENSOR FOR COIN EVALUATION

(75) Inventor: Vladymir Barchuk, Kyiv (UA)

(73) Assignee: Cashcode Company Inc., Concord (CA)

( * ) Notice: Subject to any disclaimer, the term of this patent is extended or adjusted under 35 U.S.C. 154(b) by 0 days.

(21) Appl. No.: 09/546,907

(22) Filed: Apr. 10, 2000

Related U.S. Application Data

(63) Continuation of application No. PCT/CA00/00072, filed on Jan. 28, 2000.

(51) Int. Cl.[7] ..... G07D 5/08

(52) U.S. Cl. ..... 194/317; 194/330; 194/335; 194/337

(58) Field of Search ..... 194/317, 318, 194/328, 330, 335, 337

(56) References Cited

U.S. PATENT DOCUMENTS 1,421,831 A * 7/1922 Reith
1,882,506 A * 10/1932 Knee
4,726,458 A * 2/1988 Gati ..... 194/330
4,815,579 A * 3/1989 Fritz ..... 194/318
5,386,901 A * 2/1995 Ibarrola et al. ..... 194/244
5,687,829 A 11/1997 Churchman
6,340,082 B1 * 1/2002 House et al. ..... 194/317

FOREIGN PATENT DOCUMENTS

| | | | |
|---|---|---|---|
| CH | 655 810 | 5/1986 | |
| DE | 18 09 738 | 6/1970 | |
| DE | 3303179 A1 * | 2/1984 | ..... G07F/1/04 |
| EP | 0 343 871 | 11/1989 | |
| GB | 2 226 678 | 7/1990 | |
| JP | 4-311294 A * | 11/1992 | ..... G07D/5/08 |
| JP | 0520597 A2 * | 12/1992 | ..... G07F/1/04 |
| JP | 6-162309 A * | 6/1994 | ..... G07D/5/08 |

* cited by examiner

*Primary Examiner*—Donald P. Walsh
*Assistant Examiner*—Mark J. Beauchaine

(57) ABSTRACT

A capacitance sensor measures a coin to determine geometrical parameters thereof and to allow assessment of different geometrical parameters of a coin which influence the measured capacitance. In a preferred arrangement, a mechanical arrangement alters the capacitance between two electrodes as a function of the diameter of the coin. This assessment is used in combination with a further measured capacitance which is a function of coin diameter, coin thickness and surface relief of the coin. The initial evaluation of diameter is useful in determining the separate influences of coin thickness and surface relief. The invention is also directed to the method of coin evaluation.

16 Claims, 5 Drawing Sheets

CAPACITANCE SENSOR FOR COIN EVALUATION

The present application is a continuation of International Application PCT/CA00/00072 filed Jan. 28, 2000.

BACKGROUND OF THE INVENTION

The present invention relates to coin evaluators and in particular, to a capacitance sensor for coin evaluation. There are a number of different sensors designed to evaluate metallic coins. Inductive sensors are commonly used and are sensitive to many inherent characteristics of coins simultaneously. Inductive sensors are responsive to magnetic permeability of the coin material, conductivity, quantity of the material and size of the coin. The simplest inductive sensors produce a response that depends on all of these characteristics, and as such, the resulting security is not high. Some inductive sensors attempt to measure the separate contributions of these characteristics, however, this requires a significant increase in the sophistication of the coin acceptor and its electronic evaluation system.

An alternate approach to improve the security of coin acceptors, is to have additional non inductive sensors. These sensors can provide a separate evaluation of the same characteristics that are influencing the inductive sensor signal (e.g., the coin diameter) or other characteristics such as coin weight. In the first case, the additional sensors can distinguish some of the characteristics influencing the inductive sensor signal while in the second case additional information is obtained.

In general, coin forgery is unprofitable primarily due to the low value of the coins. Unfortunately, coins of two countries which are of drastically different real values may be indistinguishable by coin acceptors because the coins are basically the same, other than the impressed patterns on the coins. Similarly, some industrially produced metallic washers without stamping on their surfaces are also indistinguishable from some coins by many coin acceptors.

There remains a need for an effective sensor which is most effective and is effective in distinguishing coins.

SUMMARY OF THE INVENTION

The capacity sensor of the present invention distinguishes coins by measuring the effect of the coin's periphery, and the parameters of the pattern impressed on the coin faces. In a preferred embodiment, the characteristics of the edge surface of the coins is measured.

According to the present invention, a capacity sensor arrangement evaluates geometrical parameters of coins in combination with a measurement of other parameters which impact capacitance to improve the security level of the coin acceptor.

According to the present invention a capacity sensor measures geometrical parameters of coins and utilizes the same electronic evaluation system for measuring all the parameters analyzed.

According to a preferred aspect of the invention, the capacity sensor measures the geometry of the periphery of the coin, and in particular, the diameter of the coin, the thickness of the coin, and an assessment of the pattern impressed on the faces of the coin.

The preferred capacity sensor includes a measuring capacitor and an auxiliary mechanical system. The measuring unit consists of two flat multilayer electrode systems, mounted parallel to each other on the opposite sides of a coin acceptor channel. The electrode systems are sized to cover the largest coin that the acceptor will accept. Each electrode system includes an active electrode facing the channel of the acceptor that includes a thin insulating covering layer thereover. A screening electrode is situated on the opposite side of the electrode system. It is separated from the active electrode by a thick insulating layer. Active electrodes of the two electrode systems form the measuring capacitor. The walls of the coin acceptor are inclined from vertical so that a coin moves closer to one of the walls. The first electrode system is mounted on the inclined wall and is fixed. The second electrode system selectively is mounted on the opposite wall and selectively moves towards the first electrode system to clutch a coin therebetween.

The first electrode system includes an additional electrode that is electrically connected with the active electrode of the same electrode system. An electromechanical system of the coin acceptor halts the coin inside the channel between the electrode systems, shifts the movable electrode system until the coin is clutched between the movable and fastened electrode systems, and subsequently shifts the movable system back releasing the coin for further movement along the channel. The auxiliary mechanical system includes a lever fastened to a passive electrode by a common shaft. The auxiliary mechanical system is mounted so that the lever is situated in the channel of coin acceptor and is displaced when the coin moves inside the channel. The displacement of the lever causes a displacement of the passive electrode relative to an additional electrode and the screening electrode of the first electrode system. With movement of the lever, the ratio of the passive electrode covering the additional and screening electrodes changes.

The electronic system is connected with the active electrodes of both electrodes systems; it measures the variation of the measuring capacitor capacity during the movement of a coin along the acceptor channel when the coin is between the electrode system and when the coin is clutched between the electrode systems.

When the coin moves along the coin acceptor channel past the lever, the maximum rotation angle value of the lever depends on the coin diameter. When the sharp edge of the lever slides over the edge surface of the coin the movement of the lever reflects the form of this surface. The corresponding rotation of the lever causes the shift of the passive electrode and leads to the variation of capacitive coupling between the additional and screening electrodes, and causes a variation of the measuring of the measuring capacitor. Any abrupt changes due to edges of the coin cause a change in this value. The coin continues along the coin acceptor channel until it is located between the electrode systems and the value of the measuring capacitor increases. The measured value is primarily a function of coin diameter and thickness. When the coin is clutched between the electrode systems the main contribution to the capacity of the measuring capacitor is made by the capacities between the measuring electrodes and faces of the coin and depend on the impressed pattern parameters, namely, on the depth of the relief and the ratio of concave and convex surface fragments on both faces of the coin.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
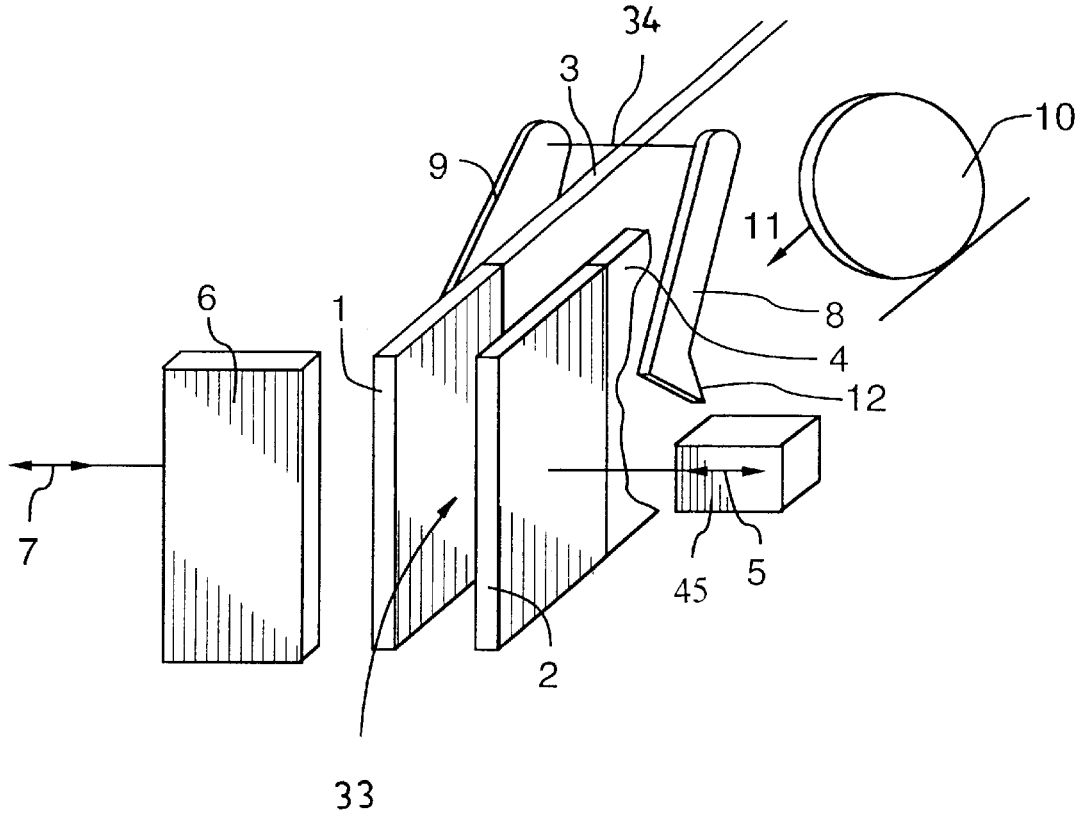
FIG. 1 is a perspective view of the capacity sensor for measuring of coins.

A perspective view of a capacity sensor for measuring the geometric characteristics of coins is shown in FIG. 1. Two flat multilayer electrode systems 1 and 2 are positioned on opposite walls 3 and 4 of the coin acceptor channel 33. The electrode system 1 is fixed on the wall 3 of the channel and the electrode system 2 is movable towards or away from electrode system 1 by an electromechanical system 45 of the coin acceptor in the directions shown by the arrows 5. The movable electrode system 2 moves between an end position where the electrode system is located in the plane of channel wall 4 and a coin clutching position. Electrode systems 1 and 2 are separated by the width of the coin acceptor channel 33 when electrode system 2 is at the end position and the electromechanical system accurately controls the position of electrode system 2. The coin clutching position changes according to the thickness of the coin, but allows clutching of any type of coins that can be received in the coin acceptor.

There is also an arrangement that halts the coin between the electrode systems 1 and 2 before clutching. An example of the arrangement is the blind 6 that shuts the acceptor channel 33 immediately downstream of the electrode systems 1 and 2. Movement of the blind 6 is shown by arrows 7 and is controlled by the electromechanical system.

An auxiliary mechanical system of the sensor includes the lever 8 fastened to shaft 34 which causes the sympathetic rotation of the passive electrode 9. The lever is located in the acceptor channel 33 and the passive electrode is located behind the electrode system 1 and parallel to the channel.

The sequence of mechanical operations can be appreciated with reference to FIG. 1. In the initial state the blind 6 shuts the acceptor channel 33. The channel is inclined from the vertical and any inserted coin 10 moves freely along the channel in the direction shown by the arrow 11 due to a gravity bias. During this movement, one face of the coin slides along the channel wall 3 due to an inclination of the channel. While moving the coin strikes the lever 8 and the sharp edge 12 of the lever 8 slides along the edge surface of the coin and traces the shape thereof. The movement of the lever causes a sympathetic rotation of the passive electrode 9 as the electrode is fastened to the lever 8 by common shaft 34. As such, any abrupt transitions due to change in the periphery of the coin are translated to abrupt movements of the passive electrode and a change in capacitance.

The coin continues along the channel 33 into the space between the electrode systems 1 and 2 and is stopped by the blind 6. The electrode systems sense the coin (increase in capacitance) and electrode system 2 moves until the coin is tightly clutched. After tight clutching, electrode system 2 moves to the end position of FIG. 1, the blind 6 opens t he channel and the coin continues its movement along the channel.

For some applications it is possible to use a simplified algorithm where the channel is always open. In this case, the coin is not clutched by the electrode systems and electrode system 2 is fixed or remains in the clear end position. This feature of tightly clutching the coin in some applications can be turned off. For example, bent coins typically would be rejected and it may be desirable to reduce the security level by turning off the clutching feature.

Figure 2:
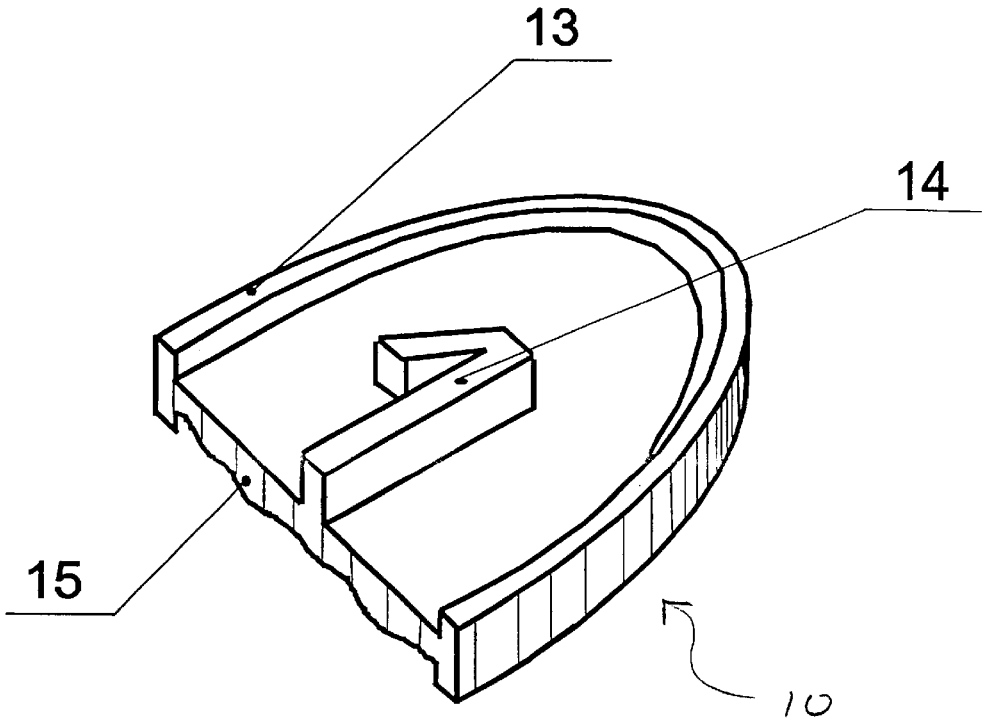
FIG. 2 is a perspective view of one half of a coin illustrating the changing cross-section of the coin.

In the preferred embodiment, the coin passes the sensor as it moves along the channel and is then stopped between the electrode systems and evaluated. This evaluation can be appreciated with reference to FIG. 2 which shows the cross-section 15 of a coin and the relief of the impressed pattern which affects the measured capacitance. Almost any coin has a brim 13 that is higher than the convex fragments of the impressed pattern 14 on both faces of the coin. The maximum thickness of a coin corresponds to the thickness of the brim.

Figure 3:
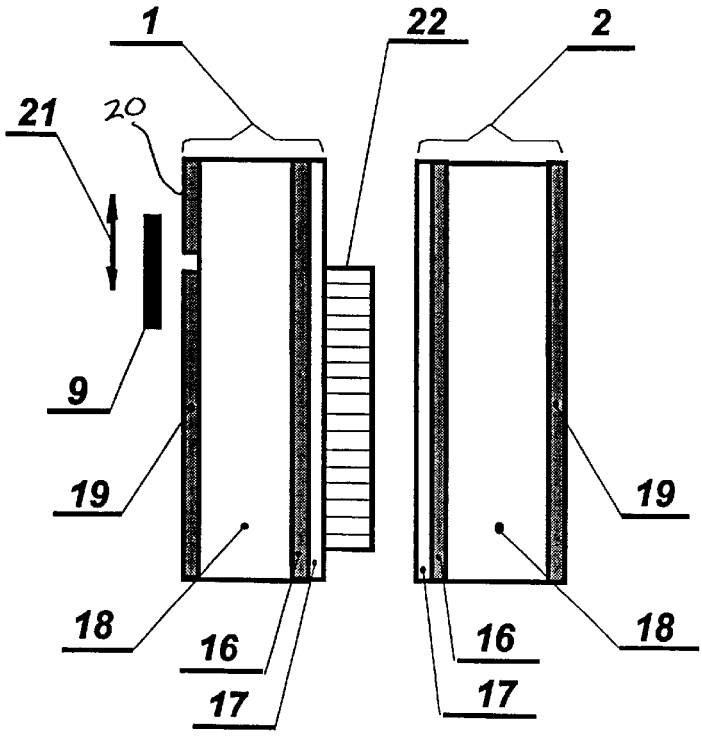
FIG. 3 is a schematic figure of the electrode systems positions when the coin is initially received.

FIG. 3 shows the cross-section of the electrode systems of the sensor corresponding to the initial state of the electrode system 2, aligned with wall 4 of the coin acceptor channel. The planes of electrode systems 1 and 2 are parallel to each other. Each electrode system is a flat multilayer system and contains an active electrode 16, separated from the acceptor channel by thin insulating covering 17. The screening electrode 19 is located on the opposite side of the active electrode 16 of electrode system 1. It is separated from the active electrode 16 by thick insulating layer 18. The size of the active electrodes is large enough to cover any type of coin that the acceptor can receive. In contrast to the movable electrode system 2, the electrode system 1 contains an additional electrode 20 that is placed above the screening electrode 19; the additional electrode is electrically connected with the active electrode 16 of the same electrode system. The passive electrode 9 of the auxiliary mechanical system is situated over the additional electrode 20 and screening electrode 19 of the electrode system 1. The separation distance between the passive electrode 9 and the electrode system 1 is constant. The rotation of passive electrode 9 caused by lever 8 is indicated by arrows 21. While the coin 22 moves between the electrode systems, it slides over the surface of the fixed electrode system 1. The screening electrodes 19 of each system diminish the influence of both the surrounding electronic elements and movable metallic and dielectrical details of the coin acceptor on the sensor. Another advantage of the screening electrodes for certain types of registering electronic schemes is the diminishing of the radiation of the sensor itself.

Figure 4:
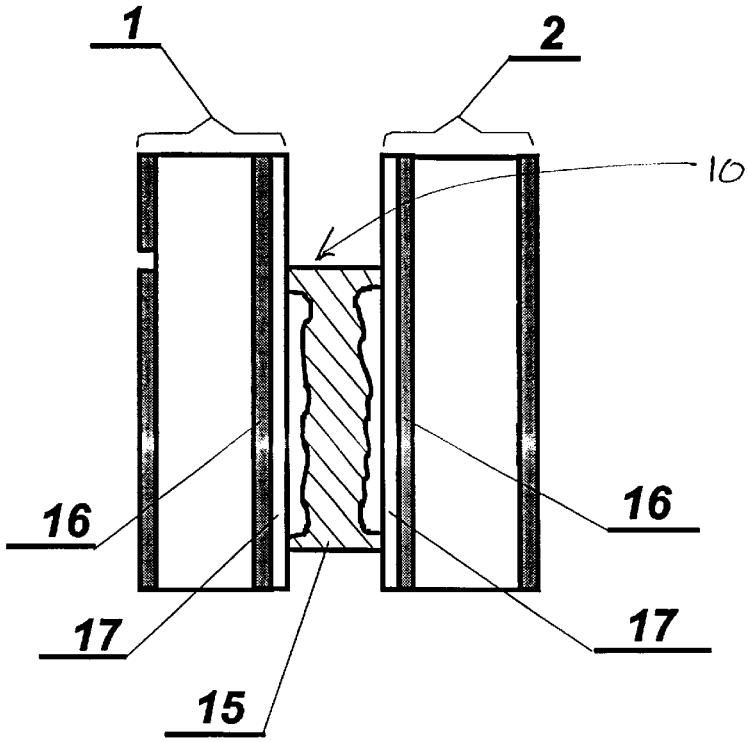
FIG. 4 is a schematic figure of the electrode systems positions when the coin is clutched between the electrode systems.

FIG. 4 illustrates the cross-section of the electrode systems and the cross-section 15 of coin 10, when the coin is clutched between the electrode systems 1 and 2. The electrode systems 1 and 2 engage the brim of the coin along its perimeter on both sides of the coin 10 producing a variable spacing of the electrodes from the surface pattern of the coin which is determined by the particular coin.

Figure 5:
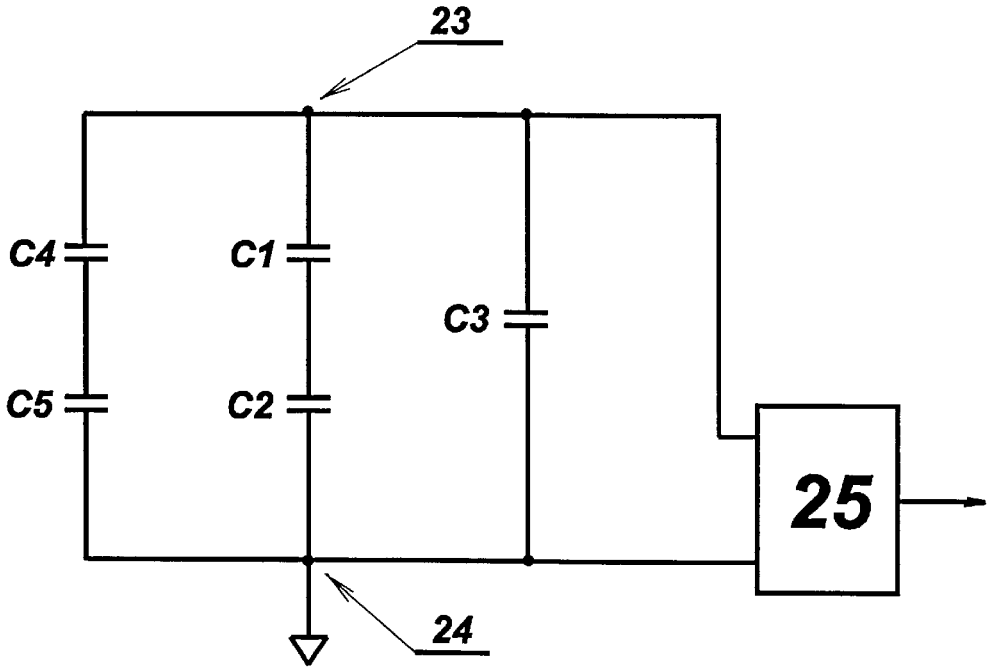
FIG. 5 is the equivalent scheme of capacities of electrodes systems and the capacities between active electrodes and the coin when located between the electrodes.

FIG. 5 shows the equivalent scheme of interelectrode capacitances of the electrode systems and the capacitances between active electrodes and the coin when the latter is located between the electrodes. The scheme implies that the screening electrodes and the active electrode 16 of the movable electrode system 2 are electrically interconnected with a common wire of the electronic registering system. The input of the electronic registering system is connected with the active electrode 16 of the stationery electrode system 1. C1 and C2 are the capacitances between the active electrodes 16 of electrode systems 1 and 2 and the nearest coin faces, respectively. C3 is the capacitance between the active electrodes 16 in free regions were there is no coin. C4 and C5 are the capacitances between the passive electrode 9 and the electrodes 20 and 19 of the electrode system 1, respectively. The capacitance between the active electrodes of both systems and the screening electrodes is not taken into account as it does not change during the coin acceptor operation. The total capacitance of the measuring capacitor is equal to the capacitance between the points 23 and 24 of the complex system of capacitances shown in FIG. 5. The electronic registering system 25 measures the total capacitance of the measuring capacitor. In the initial state, when there is no coin in the channel, the capacitors C1 and C2 should be excluded.

When the coin moves along the channel, it strikes and moves the lever of the auxiliary mechanical system causing the movement of the passive electrode. The movement of the passive electrode changes the capacitances of C4 and C5, and, therefore, changes the total capacitance of the measuring capacitor. The maximum change as the coin moves past the lever corresponds to the moment when the sharp edge 12 of the lever achieves the highest point and, thus, characterizes the diameter of the coin. The movement of this sharp edge along the surface of the brim generally traces the shape of the brim and changes the measured capacitance. Analyzing the changes in measured capacitance during the movement of the coin past the lever allows determination of both the diameter of the coin and the shape of the brim.

The coin continues to move along the channel until it is stopped between the electrode systems. This causes the emergence of C1 and C2 capacitors in the equivalent scheme (FIG. 5) and the decrease of the capacitance of C3 capacitor. The capacitances C4 and C5 return to their initial values as the coin has moved past lever 8 and lever 8 has returned to its initial position. The capacitors C1 and C2 represent the capacitances of the active electrodes 19 and the nearest surface of the coin. These capacitances increase as the diameter of the coin increases and is a function of the coin thickness. Therefore total variation of the measured capacitance simultaneously depends on two coin characteristics, the diameter and the thickness. The resulting capacitance variation is registered by the measuring system 25. As the coin diameter has also been determined independently, the thickness of the coin can be determined from the comparison of the results. When the coin is tightly clutched between the electrode systems, the equivalent scheme of the measuring capacitor is the same as shown in FIG. 5, but the interelectrode distance in C1 and C2 capacitors, varies in accordance with the impressed relief on the faces of the coin.

The smaller the thickness of the insulating coverings 17, the more sensitive the system is to the influence of surface relief. Care should be exercised as too small a thickness reduces effectiveness. With appropriate coverings 17, the dominating contribution to the capacitances of C1 and C2 is delivered by the brim of the coin. Thus the capacitance of the measuring capacitor during the clutching of the coin between electrode systems depends on the peculiarities of the relief impressed on the faces of the coin, namely on its depth and the ratio of convex and concave fragments. This capacity is also registered by the electronic registering system. Note, that it is integral characteristics of the relief of the coin that are registered. These characteristics can occasionally coincide for different types of coins but the probability of this event is low.

Figure 6:
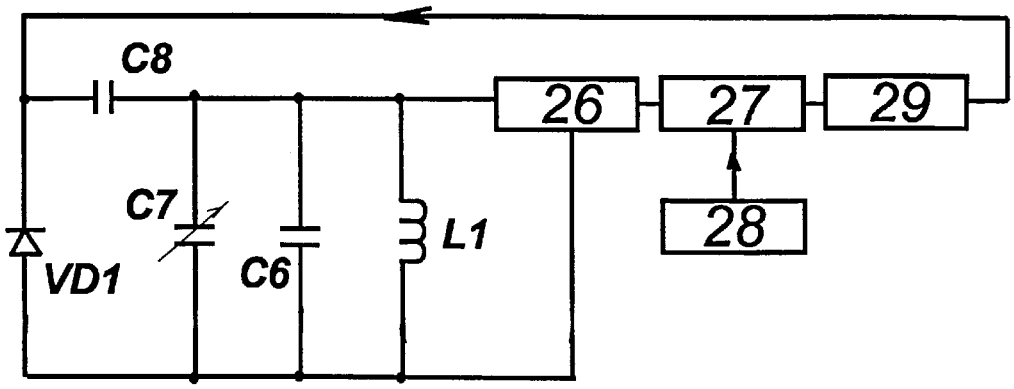
FIG. 6 is the block diagram of a version of the electronic scheme for registration of a generator frequency shift with frequency output.
Figure 7:
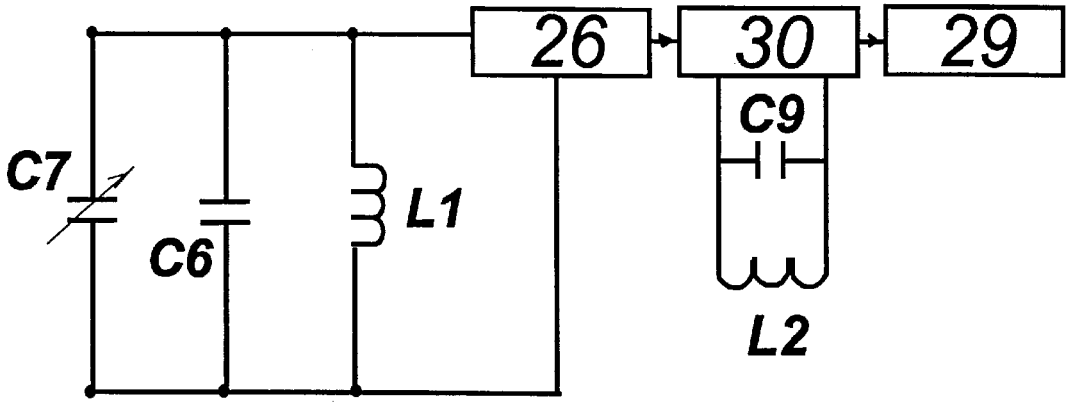
FIG. 7 is the block diagram of a version of the electronic scheme using a frequency discriminator for registration of the generator frequency shift with analogous output.
Figure 8:
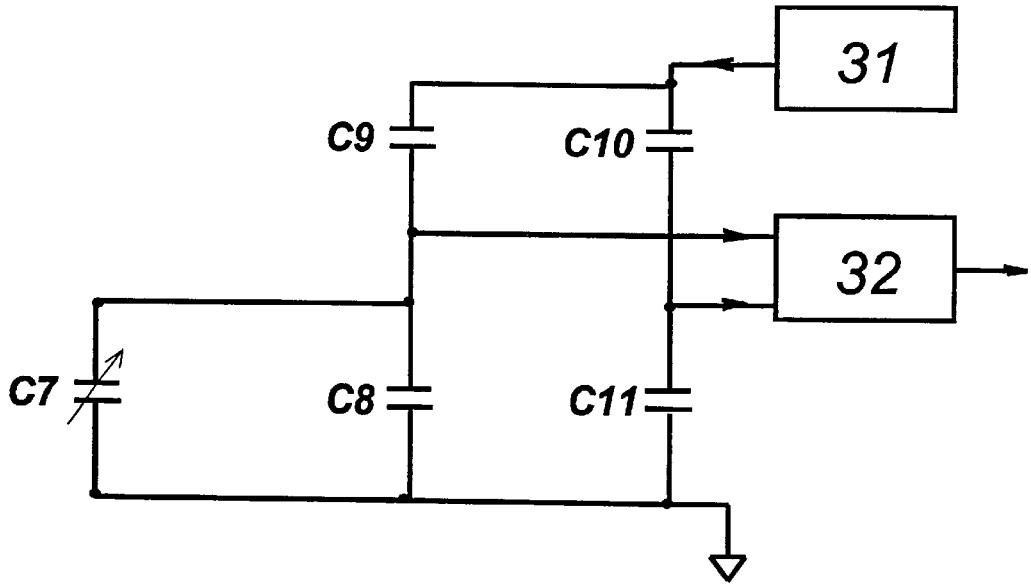
FIG. 8 is the block diagram of the electronic scheme using a capacitance bridge.

There are many types of electronic schemes suitable for application as an electronic registering system of the sensor described. Some examples of electronic arrangements that utilize the capacitance sensor are generally shown in FIGS. 6, 7 and 8. Other arrangements are possible.

FIG. 6 shows a block diagram of an electronic registering system where the measuring capacitor is an element of the oscillatory circuit of the generator, and the variation of its capacity is measured by the variation of the generator frequency. The oscillatory circuit in the generator 26 includes the connected in parallel inductance L1 and the measuring capacitor C7 of the sensor. It can also include, if necessary, capacitor C6 which can be adjusted in value to obtain the necessary initial frequency. The oscillatory circuit is connected via the capacitor C8 with the diode VD1 intended for the electronic frequency tuning. As the frequency of the generator 26 depends on the capacitance in the oscillatory circuit, it depends on the capacitance of the measuring capacitor. This frequency can be directly measured by the timer of the microcontroller system of the coin acceptor but in the case of too high frequency it can be divided or shifted.

In the arrangement of FIG. 6 the frequency is transferred by the mixer 27 and the output signal of the crystal generator 28 is used as a second frequency. In this case the timer measures the low frequency corresponding to the differences of the frequencies. It is better to use frequency transfer as compared to frequency division, as the resulting system is more sensitive. The fine tuning of the output frequency of this electronic registering system is carried out by the digital-analog converter mounted on the microcontroller board 29.

FIG. 7 shows a block diagram of an electronic registration system with the same generator 26 as shown in FIG. 6, but the measurements of its frequency variations are carried out using the frequency discriminator 30. The oscillatory circuit L2-C9 is tuned to the initial frequency of the generator 26. The output analogous signal of the discriminator 30 is registered by the analog-digital converter being a part of the coin acceptor microcontroller board.

FIG. 8 shows an electronic registering system containing a measuring capacity bridge with the measuring capacitor C7 of the sensor in one arm. The ac power is supplied by the generator 31. To form the capacity bridge the capacitors C8, C9, C10, and C11 are used. The ac voltage that appears when the bridge is unbalanced is detected by the lock-in detector 32; the output voltage of the generator 31 is used as a reference voltage. Similarly to the previous arrangements, the output voltage of the lock-in detector is registered by the analog-digital converter.

Application of the described capacitance sensor together with sensors of other coin parameters increases the security of coin acceptors. In many cases, use of the capacity sensor allows simpler versions of other sensors. It is also possible to use the simplified version of the capacitance sensor which does not have the clutching function. It is also possible to allow the switch-on or switch-off of a certain sensor's functions in accordance with the demands to coins acceptors comprised in a given equipment. For example, to switch-on or switch-off the function of the imprinted relief parameters determination can be implemented simply by changing the algorithm of coin acceptor operation. When this function is switched off, the coin acceptor can accept deformed coins that would have been rejected during the process of impressed relief parameters determination.

There are some application where the switch-off of the above function is reasonable in spite of the deterioration of the security of the coin acceptor.

It should be noted that the proposed design of electrodes that are associated with the auxiliary mechanical system need not be incorporated into electrode system 1 and other arrangements are possible. For example, the additional and screening electrodes can form a separate electrode system.

It should be understood by those skilled in the art that obvious structural modifications can be made without departing from the spirit of the invention. Accordingly, reference should be made primarily to the accompanying claims, rather then the foregoing Specification, to determine the scope of the invention.

The embodiment of the invention in which an exclusive property or privilege is claimed are defined as follows:

1. A coin evaluator comprising a capacitance sensor, a coin channel for receiving and guiding a coin through said capacity sensor, and electronic circuitry for processing signals of said capacity sensor relative to predetermined standards;

and said capacity sensor including two opposed electrode systems movable relative to said channel and each other from a position allowing a coin to pass between said opposed electrodes to a position where said opposed electrodes clutch a coin therebetween;

said capacity sensor further including a passive electrode associated with one of said opposed electrodes, said passive electrode moving relative to said one of said opposed electrodes as function of the diameter and peripheral edge configuration of a coin as it moves along said channel;

said electrical processing circuitry evaluating a coin based on changes in capacitance due to movement of the passive electrode and based on the measured capacitance between opposed electrodes when a coin is clutched therebetween.

2. A coin evaluator as claimed in claim 1 wherein said passive electrode includes a drive lever disposed in said channel and said lever is displaced by a coin as the coin moves along said channel past said lever.

3. A coin evaluator as claimed in claim 1 wherein one of said two opposed electrode system is stationary and forms part of said coin channel and wherein the other electrode system is movable to allow clutching of a coin between said electrode system.

4. A coin evaluator as claimed in claim 3 wherein said passive electrode is associated with said stationary electrode system.

5. A coin evaluator as claimed in claim 1 wherein each electrode system includes a thin insulating cover positioned to contact a coin in said channel, an active electrode behind said insulating cover, followed by a thick insulating layer and a screening electrode behind said thick insulating layer.

6. A coin evaluator as claimed in claim 5 wherein said passive electrode is associated with a stationary assessment electrode and the capacitance therebetween changes as a function of the position of said passive electrode.

7. A coin evaluator as claimed in claim 6 wherein said passive electrode connected to and moved by a pivotting lever, said pivotting lever including a coin engaging point which follows a peripheral edge of a coin as the coin moves past said lever.

8. A capacitance sensing arrangement for distinguishing geometric characteristics of coins comprising:

a coin channel for receiving and guiding a coin for processing;

a stationery electrode system associated with said coin channel;

a movable electrode system disposed in an opposed parallel manner to said stationary electrode system and movable towards said stationary electrode system to engage a coin between said stationary and said movable electrode system;

a mechanical arrangement partially disposed in said channel contacting the periphery of a coin as it moves along said coin channel such that said mechanical arrangement is moved in accordance with the size and the shape of the periphery of the coin;

a passive movable electrode connected to said mechanical arrangement and movable relative to said stationery electrode in accordance with movement of said mechanical arrangement and thereby alter the capacitance between the passive electrode and the stationery electrode in accordance with the size and shape of the coin; and processing means for measuring capacitance between the electrodes and making a determination of the coin by comparing with reference specifications of coins to be accepted.

9. A process for evaluating a coin comprising:

moving the coin along a coin evaluation channel positioning a sensing arm in said coin evaluation channel such that the sensing arm contacts and is displaced by a peripheral edge of the coin, measuring the responsive movement of the sensing arm as a coin moves therepast and based on the measured responsive movement assessing the diameter and peripheral edge shape of the coin; stopping the coin in the evaluation channel and engaging the coin with opposed electrode systems and measuring the change in capacitance value caused by geometric characteristics of the coin, using the measured change in capacitance value caused by the coin and the assessed diameter and peripheral edge shape to compare the coin to a predetermined standard of coins and based thereon accepting or rejecting the coin.

10. A capacity sensor for measuring coins geometric parameters said sensor comprising:

a) a flat multilayer stationary electrode system that is placed on one side of a coin acceptor channel;

b) a flat multilayer movable electrode system placed on the channel wall, in opposed position to said stationary electrode system;

c) an auxiliary mechanical system having a coin engaging lever which controls the position of a passive movable electrode with the lever situated in the coin acceptor channel and the passive movable electrode moving across the surface of an additional stationary electrode associated with said stationary electrode system, wherein the movement of the lever due to a coin passing thereby causes a rotation of the passive movable electrode thus altering the capacitance value between the passive electrode and an additional electrode, and wherein said movable electrode system selectively moves to clutch a coin between said movable electrode system and said stationary electrode system and measuring the change in capacitance value caused by geometric characteristics of the coin.

11. A capacitance sensor as claimed in claim 10 including an electromechanical system positioned to halt a coin between the electrode systems and move the movable electrode system until the coin is tightly clutched between the electrode systems.

12. A capacity sensor as claimed in claim 11 including an electronic register system connected to the electrode systems and measures the variation of the capacity between the electrode system caused by the diameter and the peculiarities of the peripheral edge of a coin when it strikes and displaces the lever of the auxiliary mechanical system, measuring changes in capacity caused by the diameter and the thickness of the coin, when the coin is located between the electrode systems, and the electronic measuring system measuring characteristics of the impressed relief or the faces of the coin, when the coin is tightly clutched between the electrode systems.

13. The sensor of claim 12 wherein the movable electrode system contains on its side opposite to the channel a grounded screening electrode that is separated from the active electrode on the electrode system by thick insulating layer.

14. The sensor of claim 12 wherein each electrode system includes active electrodes sized to cover all types of coins that can be received by the coin acceptor channel.

15. The sensor of claim 12 wherein the movable electrode system is movable between a first position in the plane of the coin acceptor channel wall and a second position where a received coin is tightly clutched between the movable and stationary electrode systems.

16. The sensor of claim 10 wherein the lever of the auxiliary mechanical system has a sharp edge that engages the coin and moves along the edge surface of a received coin reproducing the features of a peripheral edge of the coin.

* * * * *